US006610870B1

(12) United States Patent
Selder

(10) Patent No.: US 6,610,870 B1
(45) Date of Patent: Aug. 26, 2003

(54) LINSEED OIL AND METHOD FOR PREPARATION THEREOF

(75) Inventor: Mikkel Selder, Huddungeby (SE)

(73) Assignee: Linotech AB, Järlåsa (SE)

( * ) Notice: Subject to any disclaimer, the term of this patent is extended or adjusted under 35 U.S.C. 154(b) by 0 days.

(21) Appl. No.: 10/089,285

(22) PCT Filed: Sep. 26, 2000

(86) PCT No.: PCT/SE00/01862

§ 371 (c)(1),
(2), (4) Date: May 28, 2002

(87) PCT Pub. No.: WO01/25376

PCT Pub. Date: Apr. 12, 2001

(30) Foreign Application Priority Data

Oct. 7, 1999 (SE) ..... 9903621

(51) Int. Cl.[7] ..... C11B 3/00; C11B 3/02

(52) U.S. Cl. ..... 554/189; 554/190; 554/195; 554/202

(58) Field of Search ..... 554/189, 190, 554/195, 202

(56) References Cited

FOREIGN PATENT DOCUMENTS

| | | | |
|---|---|---|---|
| EP | 0 052 203 | | 3/1985 |
| GB | 377336 | A | 7/1932 |
| GB | 438056 | A | 11/1935 |
| GB | 695593 | A | 8/1953 |
| GB | 701633 | A | 12/1953 |
| GB | 766394 | A | 1/1957 |
| HU | 48435 | | 3/1910 |
| HU | 189 537 | | 6/1988 |

*Primary Examiner*—Deborah D. Carr
(74) *Attorney, Agent, or Firm*—Burns, Doane, Swecker & Mathis, L.L.P.

(57) ABSTRACT

Processed linseed oil essentially consisting of linolenic, linolic and oleic acids, mainly in the form of triglycerides, its content of free tocoferol being less than about 100 ppm; and a process for the manufacture of linseed oil comprising the following steps: a) heating crude linseed oil to an increased temperature lower than the boiling point of water, b) adding a heated inorganic acid to the oil and mixing the oil, c) separation of precipitated materials, d) adding a heated aqueous solution of alkali to the oil and mixing the oil, e) discharge of the soap formed, and f) rinsing the oil with hot water until a clear rinsing water is obtained.

26 Claims, No Drawings

LINSEED OIL AND METHOD FOR PREPARATION THEREOF

This application is a 371 of PCT/SE00/01862 filed Sep. 26, 2000.

The present invention relates to linseed oil which has been processed for the purpose of improving the properties of the oil in connection with the use in for example impregnation of products based on cellulose, such as wood. The invention also relates to a process for the manufacture of such linseed oil.

Even if the present invention is applicable in relation to other cellulose-based products than wood the invention will in the following be described in connection with wood in the form of different types of lumber. Decomposition of wood when used outdoors is almost exclusively caused by fungi and bacteria. The requirement for growth of such micro-organisms is the presence of water. Furthermore, a suitable temperature and access to nutrition and oxygen are required. Prevention of decomposition can be based on the elimination of one or more of these conditions necessary for the growth of the micro-organisms. As an example there can be mentioned that if the moisture content is brought down to a value lower than about 20% biological decomposition is substantially prevented.

A number of different impregnation processes for the protection of wood are known, and these methods can in principle be divided up into techniques based on the supply of a substance poisonous to the growth of the micro-organisms, and techniques whereby the wood is given hydrofobic properties, for example by impregnation with some kind or oil. In the latter case an impregnation agent is crude linseed which can be of hot- or cold-pressed type, both of which by suitable heat treatment are concerted into boiled linseed oils. The use of such linseed oils is, however, associated with certain drawbacks for example a viscosity which is unfavourably high for ease of handling, a contents of components constituting substrate for the relevant micro-organisms, unfavourable drying properties, etc. One method used for lowering the viscosity is dilution with a solvent something which, however, is environmentally unacceptable. The use of chemical poisons is presently frequently used but should for the future be mainly prohibited for environmental reasons. Also impregnation with a combination of hydrofobation and toxic treatment is used, for example treatment with creosote.

The present invention has for an object to provide a processed linseed oil with properties which are substantially improved, mainly in connection with the use of the linseed oil for the impregnation of wood and wood products.

Another object of the invention is to provide a process for the manufacture of such linseed oil of improved properties.

Yet an object of the invention is to provide a process, whereby the uptake of the oil by the wood or the wood product in connection with impregnation is substantially increased and can even reach a near 100 percent level of uptake.

In connection with extensive research and experimental work it has in accordance with the invention been found that a treatment of linseed oil resulting a situation that its content of free tocoferol will be less than about 100 ppm, results in substantially improved properties of the linseed oil, particularly in connection with its use as an impregnating agent for wood or lumber.

These and other objects of the invention which will be clear from the following description are obtained by a processed linseed oil essentially consisting of linolenic, linolic and oleic acids, mainly in the form of triglycerides, the linseed oil being characterized in that its contents of free tocoferol is less than about 100 ppm.

It is particularly preferred that the processed linseed oil contains free tocoferol in a concentration less than about 75 ppm and particularly less than about 50 ppm.

Even if the processed linseed oil according to the present invention can be based on cold pressed as well as hot pressed linseed oil it is preferred to use cold-pressed linseed oil as a starting material for the linseed oil according to the invention.

The new process according to the invention for the manufacture of a linseed oil of the above type is characterized by the following steps:

a) heating crude linseed oil to an increased temperature lower than the boiling point of water, b) adding a heated inorganic acid to the oil and mixing the oil, c) separation of precipitated materials, for example by sedimentation and discharge and removal of bottom deposit formed, d) adding a heated aqueous solution of alkali to the oil and mixing the oil, e) discharge of the soap formed, and f) rinsing the oil with hot water until a clear rinsing water is obtained.

The heating in step a) above suitably takes place at a temperature lying within the range about 80 to about 99° C. while avoiding that the boiling point of water will be reached.

The inorganic acid is preferably added in an amount of about 0.5 to 30% by weight based on the weight of the oil. Among suitable inorganic acids there may be mentioned phosphoric acid, sulphuric acid and hydrochloric acid. It is preferred to use as an inorganic acid phosphoric acid, for example thermal phosphoric acid, at a concentration of for example 80% and in a quantity of about 0.5 to about 2% by weight, particulary from about 1 to about 1.5% by weight.

The mixing in step b) suitably lasts until the reaction has come to a stop, which corresponds to a period of about 10 to about 30 minutes.

As alkali any suitable alkaline compound can be used, for example hydroxides of alkali or earth alkali metals, particularly sodium hydroxide or potassium hydroxide. Particularly preferred is sodium hydroxide, also called caustic soda. The alkaline compound is suitably added in a quantity equivalent to about 2 to 5% by dry weight based on the weight of the oil. Alkali is suitably added in the form of an aqueous solution in a quantity of about 7 to 15% by weight water also this based on the weight of the oil.

For the purpose of avoiding thickening of the oil during heating the oil may in a further step be heated while adding a suitable agent, such as manganese tetraborate. A suitable temperature range for the heating of the oil in this further step is from about 120 to about 140° C. In order to improve the trying properties of the processed oil a suitable catalyst can be added, for example example manganese tetraborate. The agent used as a catalyst can be the same as the agent used to avoid thickening of the oil during heating.

The invention will in the following be further described with reference to non-limiting examples, wherein quantities and percentages relate to weight if not otherwise stated. In the examples abbreviations concerning the fatty acid present in the linseed oil are furthermore used. Accordingly, for example oleic acid is abbreviated C18:1, linolic acid C18:2 and linolenic acid C18:3. The number following the colon thus indicates the degree of unsaturation.

EXAMPLE 1

Manufacture of Processed Linseed Oil

As a starting material in the treatment of the oil Swedish cold-pressed crude linseed oil is used. The treatment of this linseed oil takes place as follows.

The crude cold-pressed linseed oil is heated to about 90° C., and 1.2% hot 80% thermal phosphoric acid is then added to the linseed oil and mixing is carried out for about 20 minutes. The bottom deposit in the form of a black precipitate formed during this acid treatment is removed by sedimentation and discharge.

Then 3.7% 100% caustic soda dissolved in 11% heated water is added to the acid-treated linseed oil, and mixing then takes place for 7–10 minutes while observing the course of reaction. The soap formed in this alkali treatment is discharged and the linseed oil obtained is purified by rinsing with 25% by volume heated water 5 to 7 times or until the rinsing water is clear and has a pH-value normal to water.

By this treatment substantially all of the no-desired components of the linseed oil have been removed, particularly its original contents of tocoferol. In order that the oil shall possess drying properties it is then heated to about 127° C. for about 6 hours, about 0.02% manganese tetraborate being used as a catalyst, the reason being that the oil shall not thicken during boiling.

In the following examples analysis of processed linseed oils according to the present invention prepared as described above are given and also corresponding analysis data for conventional products available on the market.

EXAMPLE 2

Analysis of Processed Linseed Oil According to the Invention and Two Commercially Available Linseed Oils In the table below the designations for the linseed oils are KH.KF Eg 1382 boiled linseed oil varnish made from Swedich cold-pressed crude linseed oil from the harvest of 1998. The two commercially available oils FK.K Eg 1382 and AC.K Eg 1383 are linseed oils sold by Färghandelskompaniet in Malmö, hot-pressed boiled linseed oil and Alfort & Cronholm Grosshandel AB, Stockholm, also hot-pressed boiled linseed oil, respectively.

TABLE I

| Fatty acid composition, % | FK.K Eg 1381 | KH.KF Eg 1382 | ACK Eg 1383 | IUPAC 2.302 (m) |
|---|---|---|---|---|
| C16:0 | 5,1 | 4,1 | 5,1 | |
| C18:0 | 3,6 | 3,3 | 3,6 | |
| C18:1 | 18,1 | 12,2 | 18,1 | |
| C18:2 | 15,6 | 14,8 | 15,7 | |
| C18:3 | 55,9 | 64,1 | 55,9 | |
| C20:0 | 0,2 | 0,1 | 0,1 | |
| C20:1 | 0,2 | 0,2 | 0,2 | |
| C22:0 | 0,1 | 0,1 | 0,1 | |
| C24:0 | 0,1 | 0,1 | 0,1 | |
| C24:1 | 0,3 | 0,4 | 0,2 | |
| Unknown | 0,8 | 0,7 | 0,9 | |
| Tocoferol, ppm | | | | IUPAC 2.432 |
| Alpha | <5 | <5 | <5 | |
| Alpha T3 | <5 | <5 | <5 | |
| Gamma | 170 | <5 | 168 | |
| Gamma T3 | <5 | <5 | <5 | |
| Delta | 5 | <5 | 5 | |

TABLE I-continued

| Fatty acid composition, % | FK.K Eg 1381 | KH.KF Eg 1382 | ACK Eg 1383 | IUPAC 2.302 (m) |
|---|---|---|---|---|
| Delta T3 | <5 | <5 | <5 | |
| Phosphorus AAS, mg/kg | 250 | 40 | 250 | IUPAC 2.423 (m) |

As is clear from the analysis data given above the content of free tocoferol has been largely lowered to 0 in the linseed oil according to the invention. Furthermore, a substantial decrease of oleic acid and an even greater decrease of the amount of phosphorus present can be noted.

EXAMPLE 3

Analysis of Processed Linseed Oil According to the Invention and Three Commercially Available Linseed Oils In the table below the designations for the linseed oils are KH.KI Eg 1387 boiled impregnating linseed oil from the harvest of 1998. The three commercially available oils BE.K. Eg 1384 is boiled linseed oil from Beckers, Stockholm, AL.R. Eg 1385 is Swedish cold-pressed crude linseed oil from Alcro Färg, Stockholm and EÀ.R. Eg 1386 is hot-pressed crude linseed oil from Eskil Åkerberg AB, Malmö, respectively.

TABLE II

| | BE.K Eg 1384 | AL.R Eg 1385 | EA.R Eg 1386 | KH.KI Eg 1387 | |
|---|---|---|---|---|---|
| Fatty acid composition % | | | | | IUPAC 2.302 (m) |
| C16:0 | 5,0 | 5,2 | 5,0 | 4,3 | |
| C18:0 | 3,6 | 3,8 | 3,1 | 3,8 | |
| C18:1 | 18,0 | 13,5 | 20,8 | 14,8 | |
| C18:2 | 15,5 | 18,0 | 15,0 | 14,5 | |
| C18:3 | 56,5 | 58,0 | 54,0 | 61,1 | |
| C20:0 | 0,1 | 0,1 | 0,2 | 0,1 | |
| C20:1 | 0,2 | 0,1 | 0,3 | 0,2 | |
| C22:0 | 0,1 | 0,1 | 0,2 | 0,1 | |
| C22:1 | <0,1 | <0,1 | 0,1 | <0,1 | |
| C24:0 | 0,1 | 0,1 | 0,1 | 0,1 | |
| C24:1 | 0,3 | 0,4 | 0,3 | 0,3 | |
| Unknown | 0,6 | 0,7 | 0,9 | 0,7 | |
| Tocoferol, ppm | | | | | IUPAC 2.432 |
| Alpha | <5 | <5 | <5 | <5 | |
| Alpha T3 | <5 | <5 | <5 | <5 | |
| Gamma | 105 | 350 | 230 | <5 | |
| Gamma T3 | <5 | <5 | <5 | <5 | |
| Delta | 5 | 5 | 5 | <5 | |
| Delta T3 | <5 | <5 | <5 | <5 | |
| Phosphorus AAS, mg/kg | 206 | 20 | 87 | 25 | IUPAC 2.423 (m) |

Also in this analysis report it can be noted that the processed linseed oil according to the invention is largely free from tocoferol, whereas the contents of oleic acid and phosphorus are lower than in two of the commercial oils, whereas the third commercial oil also has relatively low contents of oleic acid and phosphorus.

Tests carried out with the processed linseed oil according to the present invention show that it has substantially improved properties, particularly in connection with its use for the impregnation of wood and wood products. Thus, the oil according to the invention has lower viscosity and thereby improved handling, it has also by the treatment a lower contents of substances constituting substrates for micro-organisms, and it gives when used for impregnation of wood substantially improved resistance.

Thus, accelerated tests in fungus cellar have shown that the linseed oil according to the invention has substantially improved rot-resistance compared with CCA-impregnated wood products (CCA=chromium, copper, arsenic). The same holds for rot-resistance for impregnated rods inserted into moist earth in cellar climate of high relative moisture and temperature. Moreover, rot-resistance tests have been carried out with impregnated rods inserted into the ground on fields with micro-organism flora and aggressive brown rot shown that impregnation with the processed linseed oil according to the invention results in substantially improved rot-resistance compared with both CCA-impregnation and impregnation with conventional linseed oils.

It should be observed that the present invention is not restricted to the specific embodiments exemplified above. Thus, modifications and changes can be carried out within the frame-work of the invention and such changes and modifications are easily understood by those skilled in the art.

What is claimed is:

1. Processed linseed oil essentially consisting of linolenic, linolic and oleic acids, mainly in the form of triglycerides, characterized in that its content of free tocoferol is less than about 75 ppm.

2. Linseed oil according to claim 1, characterized in that its content of free tocoferol is less than about 50 ppm.

3. Linseed oil according to claim 1, characterized in that it is based on cold-pressed linseed oil.

4. A process for the manufacture of a linseed oil according to claim 1, characterized by the following steps:

a) heating crude linseed oil to an increased temperature lower than the boiling point of water, b) adding a heated inorganic acid to the oil and mixing the oil, c) separation of precipitated materials, d) adding a heated aqueous solution of alkali to the oil and mixing the oil, e) discharge of the soap formed, and f) rinsing the oil with hot water until a clear rinsing water is obtained.

5. A process according to claim 4, characterized in that the heating in step a) takes place to a temperature less than about 80° C.

6. A process according to claim 4, characterized in that the inorganic acid is added in a quantity of about 0.5 to 30% by weight based on the weight of the oil.

7. A process according to claim 4, characterized in that the mixing in step b) is carried out for a period of time of about 10 to 30 min.

8. A process according to claim 4, characterized in that there is used as an alkali caustic soda in solution, suitably added in a quantity equivalent to about 2 to 5% by weight dry weight based on the weight of the oil.

9. A process according to claim 8, characterized in that caustic soda is added dissolved in about 7 to 15% by weight of heated water based on the weight of the oil.

10. A process according to claim 6, characterized by a further step after the rinsing step f) constituted by heating the oil while adding an agent preventing thickening of the oil during heating.

11. A process according to claim 10, characterized in that the oil is heated to a temperature of about 120 to 140° C.

12. A process according to claim 10, characterized in that manganese tetra borate is used as said agent simultaneously acting as a catalyst.

13. Linseed oil according to claim 2, characterized in that it is based on cold-pressed linseed oil.

14. A process for the manufacture of a linseed oil according to claim 2, characterized by the following steps:

a) heating crude linseed oil to an increased temperature lower than the boiling point of water, b) adding a heated inorganic acid to the oil and mixing the oil, c) separation of precipitated materials, d) adding a heated aqueous solution of alkali to the oil and mixing the oil, e) discharge of the soap formed, and f) rinsing the oil with hot water until a clear rinsing water is obtained.

15. A process for the manufacture of a linseed oil according to claim 3, characterized by the following steps:

a) heating crude linseed oil to an increased temperature lower than the boiling point of water, b) adding a heated inorganic acid to the oil and mixing the oil, c) separation of precipitated materials, d) adding a heated aqueous solution of alkali to the oil and mixing the oil, e) discharge of the soap formed, and f) rinsing the oil with hot water until a clear rinsing water is obtained.

16. A process according to claim 5, characterized in that the inorganic acid is added in a quantity of about 0.5 to 30% by weight based on the weight of the oil.

17. A process according to claim 5, characterized in that the mixing in step b) is carried out for a period of time of about 10 to 30 min.

18. A process according to claim 6, characterized in that the mixing in step b) is carried out for a period of time of about 10 to 30 min.

19. A process according to claim 4, characterized in that there is used as an alkali caustic soda in solution, suitably added in a quantity equivalent to about 2 to 5% by weight dry weight based on the weight of the oil.

20. A process according to claim 5, characterized in that there is used as an alkali caustic soda in solution, suitably added in a quantity equivalent to about 2 to 5% by weight dry weight based on the weight of the oil.

21. A process according to claim 6, characterized in that there is used as an alkali caustic soda in solution, suitably added in a quantity equivalent to about 2 to 5% by weight dry weight based on the weight of the oil.

22. A process according to claim 7, characterized in that there is used as an alkali caustic soda in solution, suitably added in a quantity equivalent to about 2 to 5% by weight dry weight based on the weight of the oil.

23. A process according to claim 7, characterized by a further step after the rinsing step f) constituted by heating the oil while adding an agent preventing thickening of the oil during heating.

24. A process according to claim 8, characterized by a further step after the rinsing step f) constituted by heating the oil while adding an agent preventing thickening of the oil during heating.

25. A process according to claim 9, characterized by a further step after the rinsing step f) constituted by heating the oil while adding an agent preventing thickening of the oil during heating.

26. A process according to claim 11, characterized in that manganese tetra borate is used as said agent simultaneously acting as a catalyst.

* * * * *